US007555810B2

(12) United States Patent
Pullins et al.

(10) Patent No.: US 7,555,810 B2
(45) Date of Patent: Jul. 7, 2009

(54) VACUUM CLEANER WITH WAND ACTIVATED CONVERSION VALVE

(75) Inventors: Alan T. Pullins, Richmond, KY (US); Shannon D. Phegley, Danville, KY (US); Donald E. Proffitt, II, Richmond, KY (US); Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 120 days.

(21) Appl. No.: 11/683,485

(22) Filed: Mar. 8, 2007

(65) Prior Publication Data

US 2007/0209142 A1 Sep. 13, 2007

Related U.S. Application Data

(60) Provisional application No. 60/780,212, filed on Mar. 8, 2006.

(51) Int. Cl.
*A47L 9/00* (2006.01)

(52) U.S. Cl. ..... 15/331; 15/334; 15/335

(58) Field of Classification Search ..... 15/328, 15/331, 334, 335; *A47L 9/00*
See application file for complete search history.

(56) References Cited

U.S. PATENT DOCUMENTS

| | | | | |
|---|---|---|---|---|
| 2,046,684 | A | | 7/1936 | Hoover |
| 2,682,681 | A | | 7/1954 | Balluff |
| 2,898,622 | A | | 8/1959 | Hurd |
| 3,869,751 | A | | 3/1975 | Boyd et al. |
| 4,225,999 | A | | 10/1980 | Martinec et al. |
| 4,243,734 | A | | 1/1981 | Dillon |
| 4,377,882 | A | | 3/1983 | Dyson |
| 4,443,910 | A | | 4/1984 | Fitzwater |
| 4,563,789 | A | | 1/1986 | Berfield |
| 4,573,236 | A | | 3/1986 | Dyson |
| 4,811,452 | A | | 3/1989 | Sumerau |
| 4,959,885 | A | | 10/1990 | Sovis et al. |
| 5,115,951 | A | | 5/1992 | Leslie et al. |
| 5,134,750 | A | | 8/1992 | King et al. |
| 5,247,720 | A | | 9/1993 | Sovis et al. |
| 5,351,361 | A | | 10/1994 | Buchtel |
| 5,355,549 | A | | 10/1994 | Steinberg et al. |
| 5,477,586 | A | * | 12/1995 | Jacobs et al. ..... 15/332 |
| 5,560,074 | A | | 10/1996 | Graham et al. |
| 6,079,077 | A | | 6/2000 | Kajihara et al. |

(Continued)

*Primary Examiner*—David A Redding
(74) *Attorney, Agent, or Firm*—King & Schickli, PLLC

(57) ABSTRACT

A floor care apparatus includes a housing having a nozzle assembly and a canister assembly. A suction inlet is provided on the nozzle assembly. A dirt collection vessel, a suction generator and a wand receiver are carried on the housing. A first air flow pathway connects the suction inlet to the dirt collection vessel and the suction generator. An air flow control valve includes a valve body received in the first air flow pathway and an actuator having at least a portion thereof extending into the wand receiver. A cleaning wand assembly is displaceable between a first storage position wherein a first end of the cleaning wand assembly is held in the wand receiver engaging the actuator and opening the valve and a second position wherein the cleaning wand assembly is withdrawn from the wand receiver for cleaning with the cleaning wand assembly thereby disengaging the actuator and closing the valve. A second air flow pathway connects the cleaning wand assembly to the first air flow pathway between the valve body and the dirt collection vessel.

16 Claims, 11 Drawing Sheets

U.S. PATENT DOCUMENTS 6,295,694 B1 10/2001 Dyson et al.
6,442,791 B1 9/2002 McRae Thomson et al.
6,533,871 B2 3/2003 Zahuranec et al.
7,356,874 B2 * 4/2008 Skinner Macleod et al. ... 15/328
2003/0101535 A1 6/2003 Gammack et al.
2005/0055796 A1 * 3/2005 Wright et al. ..... 15/353
2006/0070205 A1 * 4/2006 Fischer et al. ..... 15/334

* cited by examiner

VACUUM CLEANER WITH WAND ACTIVATED CONVERSION VALVE

This application claims the benefit of U.S. Provisional Patent Application Ser. No. 60/780,212 filed on 8 Mar. 2006.

TECHNICAL FIELD

The present invention relates generally to the floor care equipment field and, more particularly, to a floor care apparatus incorporating a wand activated flow control valve.

BACKGROUND OF THE INVENTION

Upright vacuum cleaners and extractors have become increasingly popular over recent years. Both floor care apparatus generally incorporate a nozzle assembly that rides on wheels over the floor surface to be cleaned. A canister assembly includes an operating handle that is manipulated by an operator to move the floor care apparatus to and fro across the floor. The canister assembly also includes a dirt collector that traps dirt and debris while substantially clean air is exhausted by an electrically operated fan that is driven by an onboard motor. It is this fan and motor arrangement that generates the drop in air pressure necessary to provide the desired cleaning action.

Many upright vacuum cleaners and extractors also provide a cleaning wand that is manipulated by the hand and used to clean areas typically not reachable or generally regarded as cleanable with the suction inlet of the nozzle assembly. Such apparatus are also equipped with multiple position valves that allow the operator to convert the apparatus between floor cleaning through the suction inlet of the nozzle assembly and special task cleaning through the inlet opening of the wand. Such valves must be able to seal off either the suction inlet or the inlet opening.

SUMMARY OF THE INVENTION

In accordance with the purposes of the present invention as described herein, an improved floor care apparatus is provided. The floor care apparatus comprises a housing including a nozzle assembly carrying a suction inlet and a canister assembly connected to the nozzle assembly. The apparatus further includes a dirt collection vessel and a suction generator that are both carried on the housing. In addition, a first air flow pathway connects the suction inlet to the dirt collection vessel and the suction generator. Further, a wand receiver is carried on the housing.

In addition the floor care apparatus includes an air flow control valve. The air flow control valve has a valve body received in the first air flow pathway and an actuator having at least a portion thereof extending into the wand receiver. Still further, the apparatus includes a cleaning wand assembly that is displaceable between a first or storage position wherein a first end of the cleaning wand assembly is held in the wand receiver engaging the actuator and opening the valve and a second position wherein the cleaning wand assembly is withdrawn from the wand receiver for cleaning with the cleaning wand assembly thereby disengaging the actuator and closing the valve. In addition, the apparatus includes a second air flow pathway connecting the cleaning wand assembly to the first air flow pathway between the valve body and the dirt collection vessel.

In accordance with additional aspects of the invention, the actuator includes a plug for sealing and closing an open end of the cleaning wand assembly when the cleaning wand assembly is in the first position. Further, the apparatus includes a spring that is connected to the flow control valve. The spring biases the flow control valve into a normally closed position. In addition, the flow control valve includes a pivot shaft. The valve body and the actuator pivot about a pivot axis defined by this pivot shaft.

In accordance with additional aspects of the invention, the dirt collection vessel may take a number of forms. In one embodiment the dirt collection vessel is a filter bag such as a standard vacuum cleaner bag. In another possible embodiment the dirt collection vessel takes the form of a dirt cup. That dirt cup may include a cylindrically shaped dirt collection chamber, a tangentially directed inlet and an axially directed outlet. Such a construction allows for cyclonic air flow and the cleaning benefits provided by such air flow that are well known in the art. Further, a primary filter may be provided in the dirt cup upstream from the axial outlet.

In addition, the apparatus may include a secondary filter in the first air flow pathway between the dirt cup and the suction generator. Further, the apparatus may include a final filter in the first air flow pathway downstream from the suction generator. Such a final filter removes any remaining contaminants in the air stream before the air stream is returned to the environment.

In accordance with yet additional aspects of the invention the apparatus may include at least one rotary agitator carried by the nozzle assembly adjacent the suction inlet. Further, the canister assembly may be pivotally connected to the nozzle assembly in the manner of a standard upright vacuum cleaner.

The cleaning wand assembly of the floor care apparatus typically includes a flexible hose. Further, the cleaning wand assembly may include first and second telescoping sections so that the wand may be lengthened or shortened as desired by the user. Finally, the cleaning wand assembly may also include a control handle for manipulating the wand assembly or the entire apparatus across the floor when the wand assembly is mounted in the wand receiver.

In the following description there is shown and described one possible embodiment of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification illustrates several aspects of the present invention, and together with the description serves to explain certain principles of the invention. In the drawings:

FIGS. 1*a* and 1*b* are respective front and rear perspective views of a floor care apparatus, in this instance an upright vacuum cleaner, constructed in accordance with the teachings of the present invention;

Reference will now be made in detail to the present invention, an example of which is illustrated in the accompanying drawings.

DETAILED DESCRIPTION OF THE INVENTION

Figure 1A:
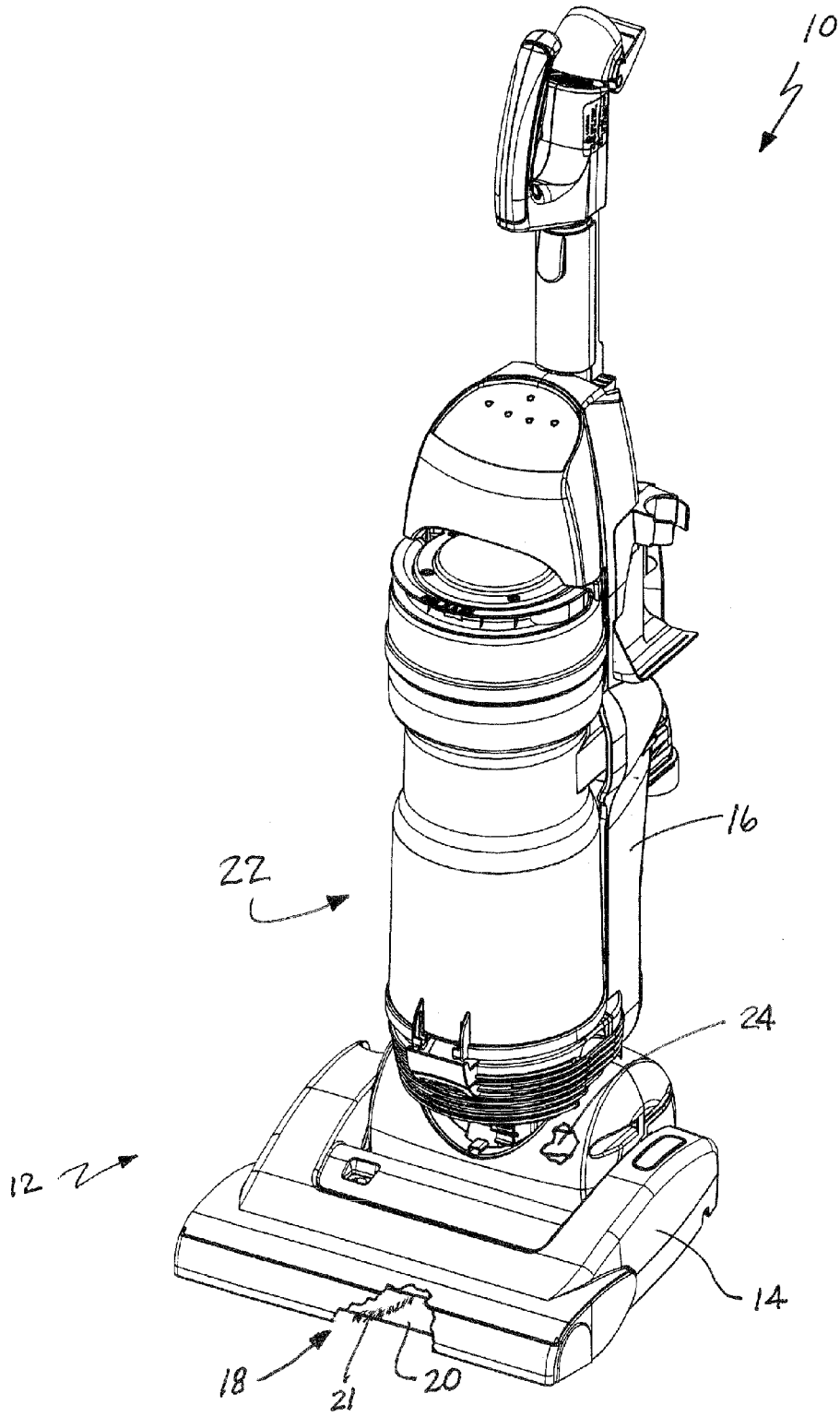
Figure 16:
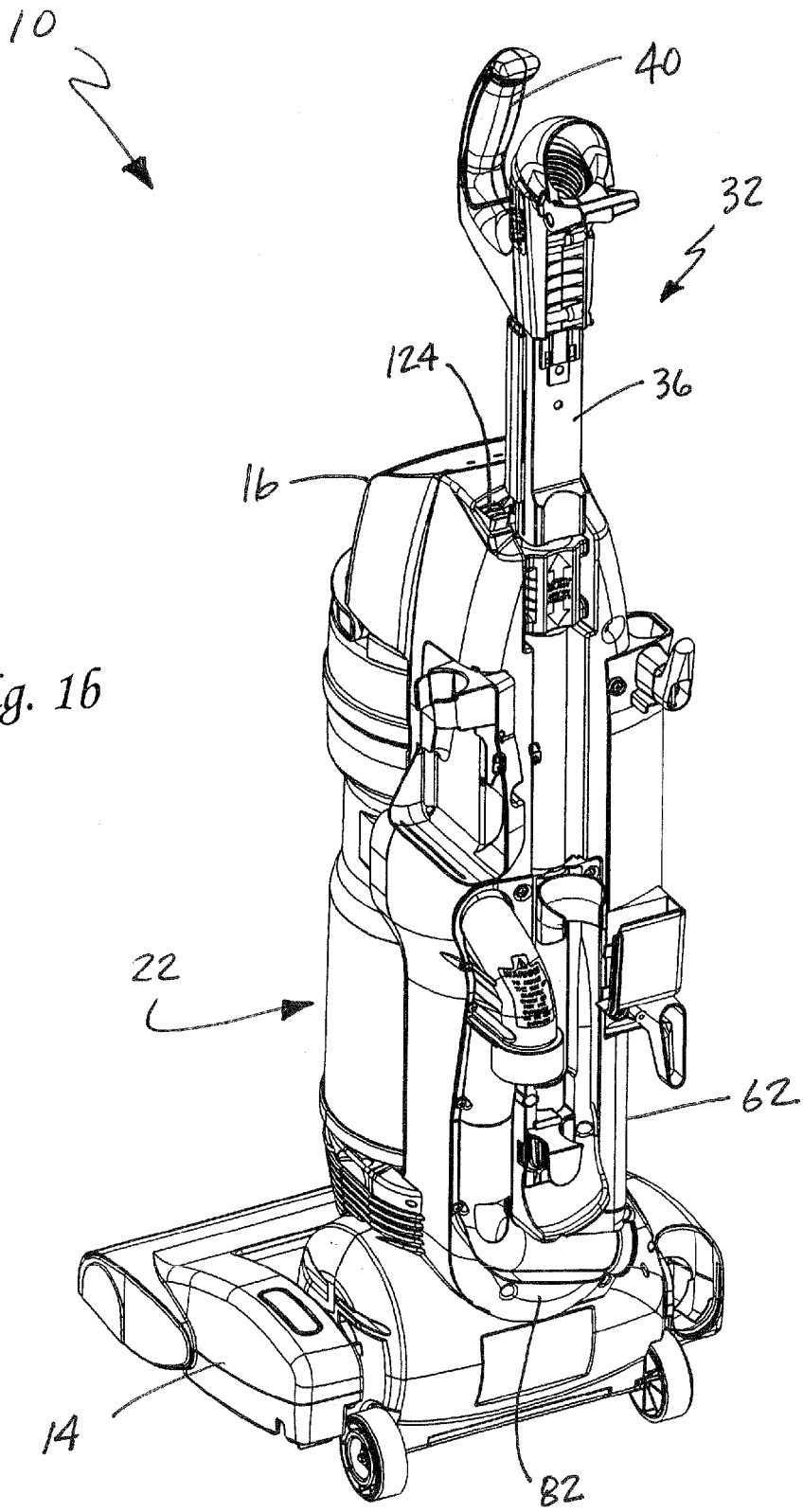

Reference is now made to FIGS. 1 and 1*a* showing a floor care apparatus 10 of the present invention. As illustrated, that apparatus 10 is an upright vacuum cleaner. It should be appreciated that while a specific upright vacuum cleaner 10 is illustrated, embodiments of the present invention also include different upright vacuum cleaners and extractors constructed in accordance with the teachings of the present invention.

The upright vacuum cleaner 10 includes a housing, generally designated by reference numeral 12, comprising a nozzle assembly 14 and a canister assembly 16. The nozzle assembly 14 includes a suction inlet 18. The nozzle assembly may also carry a rotary agitator 20 adjacent the suction inlet 18. The rotary agitator includes cleaning elements such as brushes, bristle tufts, heater bars or the like. As the rotary agitator 20 rotates, the cleaning elements 21 engage the nap of an underlying rug or carpet and serve to sweep dirt and debris into the suction inlet 18 in a manner well known in the art. The canister assembly 16 carries a dirt collection vessel, generally designated by reference numeral 22, and a suction generator 24.

Figure 6:
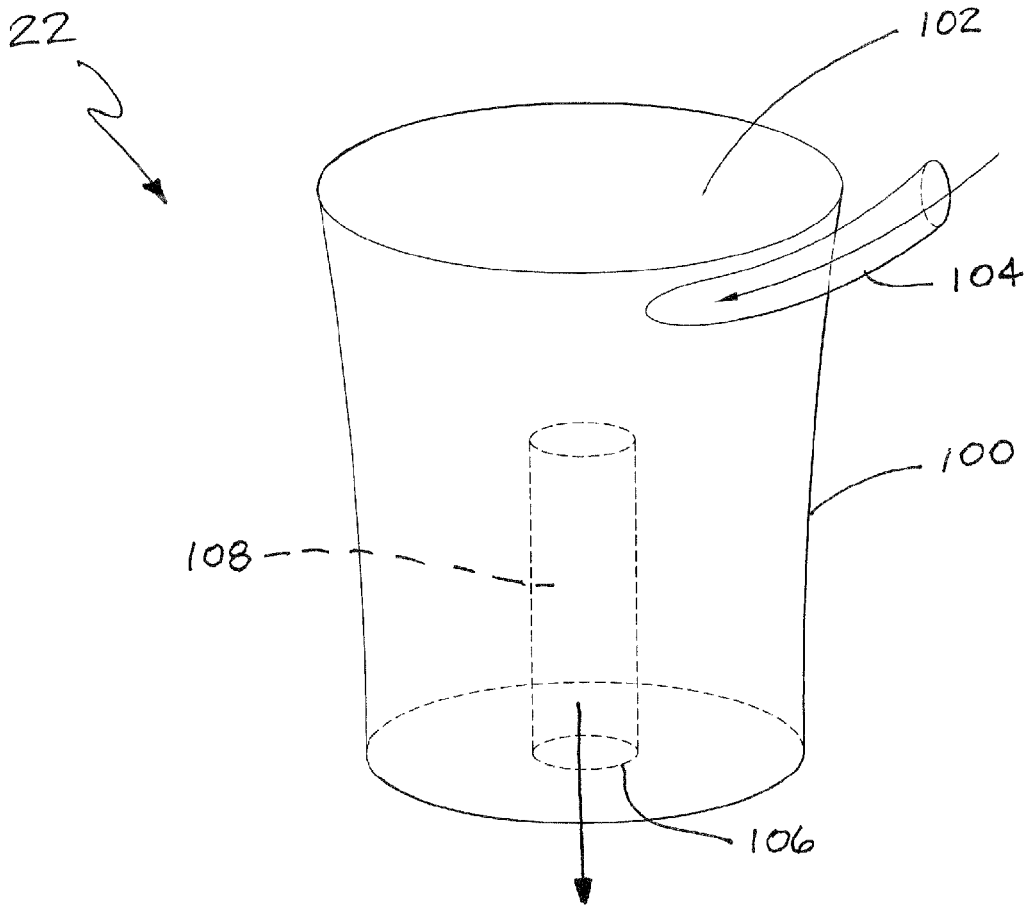
FIG. 6 is a schematical representation of a dirt cup providing for cyclonic airflow.

The dirt collection vessel 22 may take the form of a filter bag such as a standard vacuum cleaner bag, which traps dirt and debris but includes pores to allow the passage of air through the bag. Alternatively, the dirt collection vessel 22 may take the form of a dirt cup 100 as illustrated in FIGS. 1 and 6. That dirt cup 100 may include a cylindrical dirt collection chamber 102, a tangentially directed inlet 104 and an axially directed outlet 106 in order to provide for cyclonic air flow and the cleaning benefits associated with that air flow that are well known in the art. If desired, a primary filter 108 may be provided in that dirt cup 100 over the axially directed outlet 106.

Figure 7:
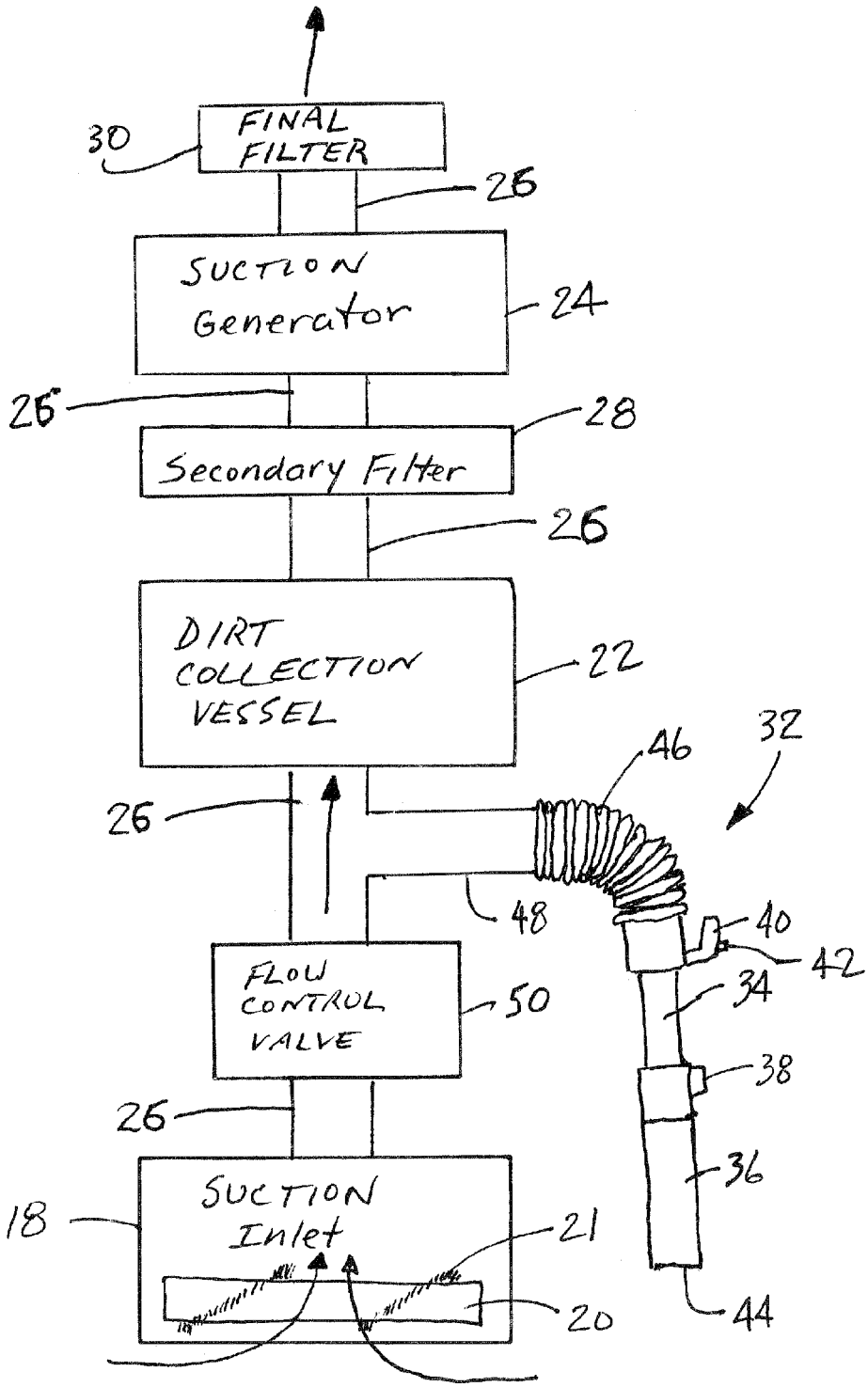
FIG. 7 is a schematical air flow diagram for the vacuum cleaner of the present invention.
Figure 8:
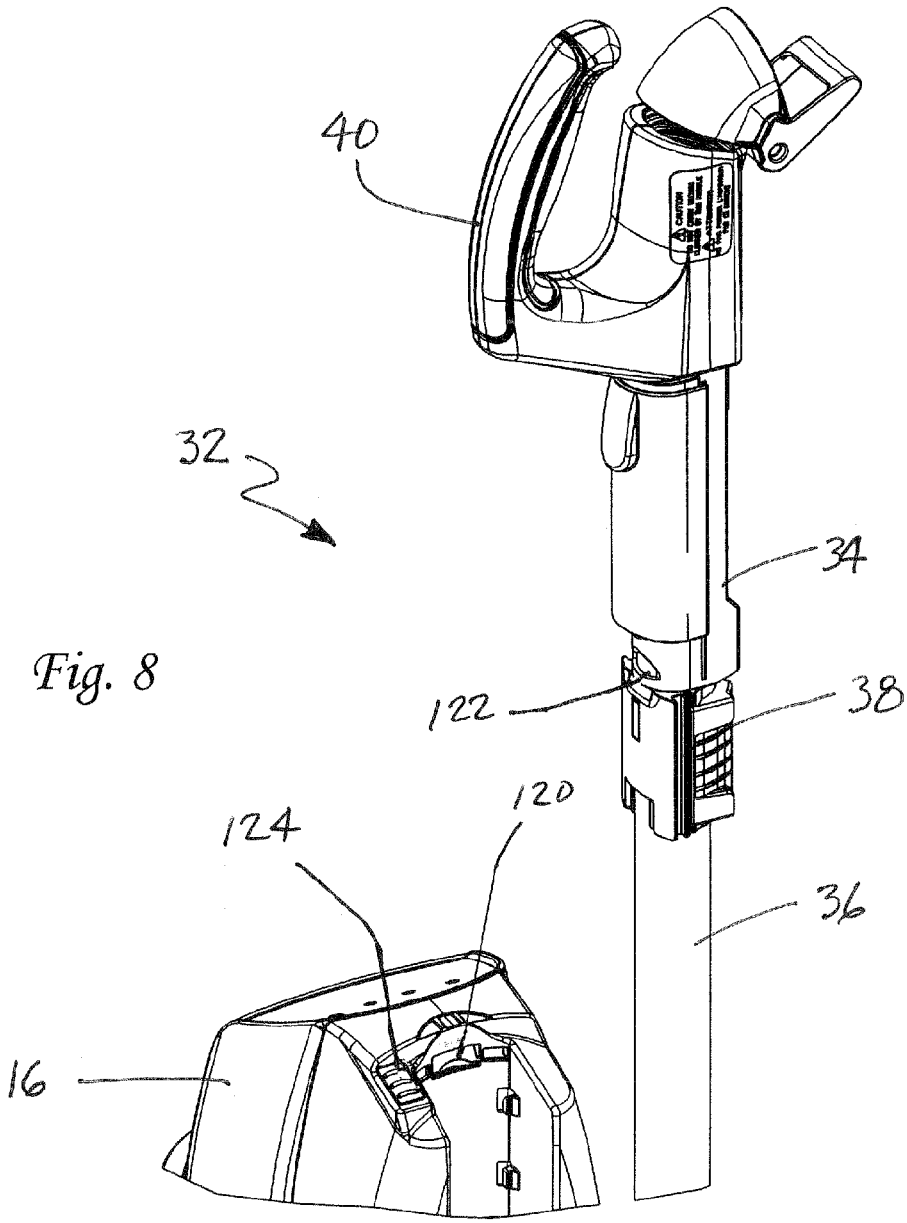
FIG. 8 is a partially exploded, perspective view illustrating the latch mechanism for holding the cleaning wand assembly in the fully seated position on the canister assembly.

As best illustrated in FIG. 7, a first air flow pathway 26 connects and provides fluid communication between the suction inlet 18, the dirt collection vessel 22 and the suction generator 24. A secondary filter 28 may be provided in the first air flow pathway 26 between the dirt collection vessel 22 and the suction generator 24. In addition, a final filter 30, such as a HEPA filter, may be provided in the first air flow pathway 26 downstream from the suction generator 24. The final filter 30 cleans any remaining dirt and debris from the air stream passing through the vacuum cleaner 10 before that air stream is returned to the environment. This includes any carbon particles that might have been picked up in the air stream after it passes over the motor of the suction generator 24 in order to provide cooling.

A cleaning wand assembly, generally designated by reference numeral 32 is carried on the housing 12 of the vacuum cleaner. As illustrated in FIGS. 1, 1*a*, 2, 4*a* and 7, the cleaning wand assembly 32 includes two telescoping tubular sections 34, 36 and a cooperating latching mechanism 38 that allows one to lengthen or shorten the wand assembly 32 as desired. The telescoping wand assembly 32 may be constructed similar to that illustrated in U.S. Pat. No. 6,148,474 to Ohara et al, the full disclosure of which is incorporated herein by reference. The wand assembly 32 also includes a control handle 40 that may be equipped with an on/off switch 42 and any other controls switching for the vacuum cleaner 10 as desired. A flexible hose 46 connects the handle end of the cleaning wand assembly 32 to a second air flow pathway 48 carried on the housing 12 which is connected to and provides fluid communication with the first air flow pathway 26 between the dirt collection vessel 22 and a flow control valve generally designated by reference numeral 50.

Figure 2:
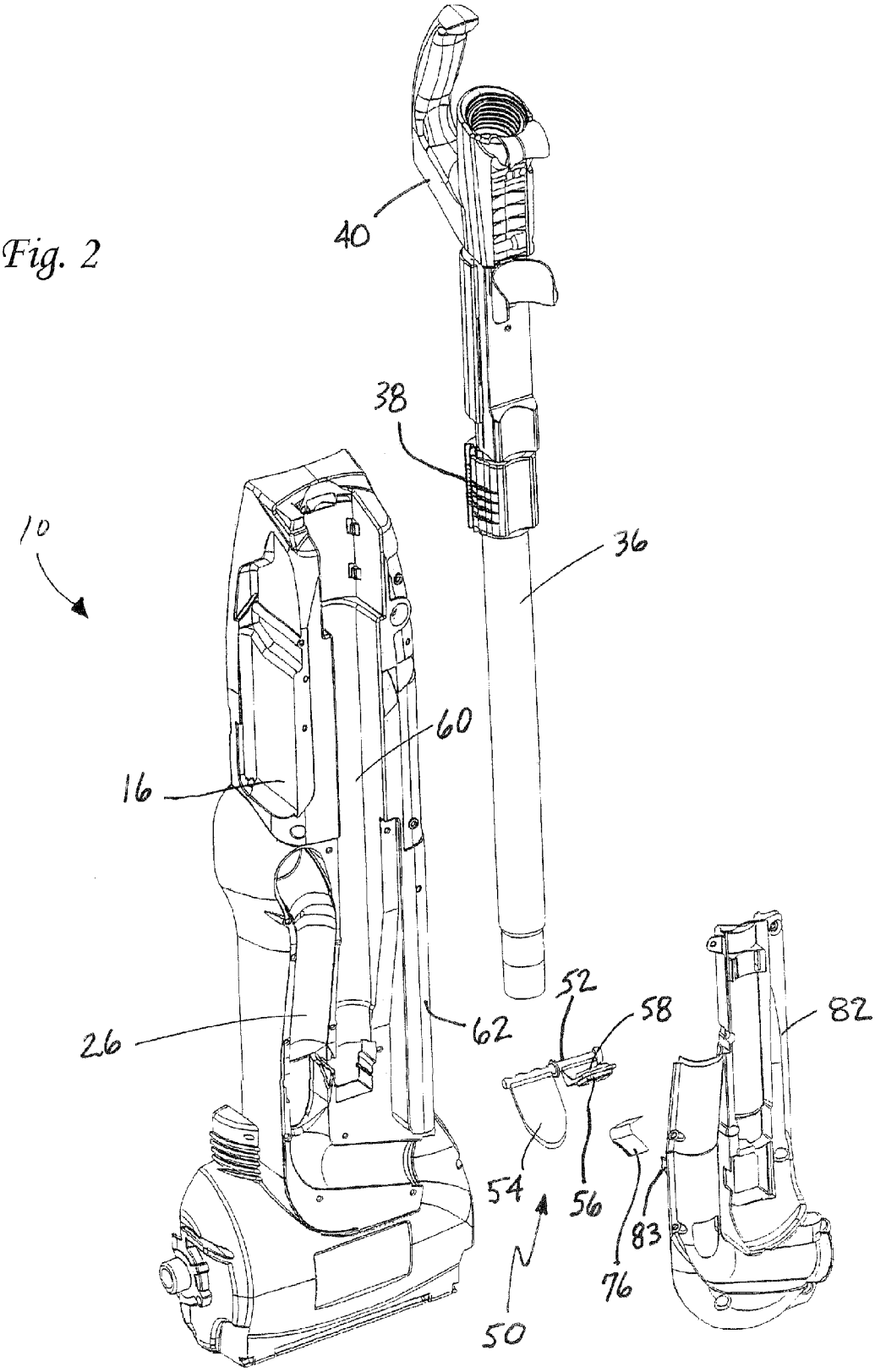
FIG. 2 is a detailed partially exploded perspective view illustrating the rear of the canister assembly including a portion of the first air flow pathway, the cleaning wand assembly and the flow control valve.
Figure 3:
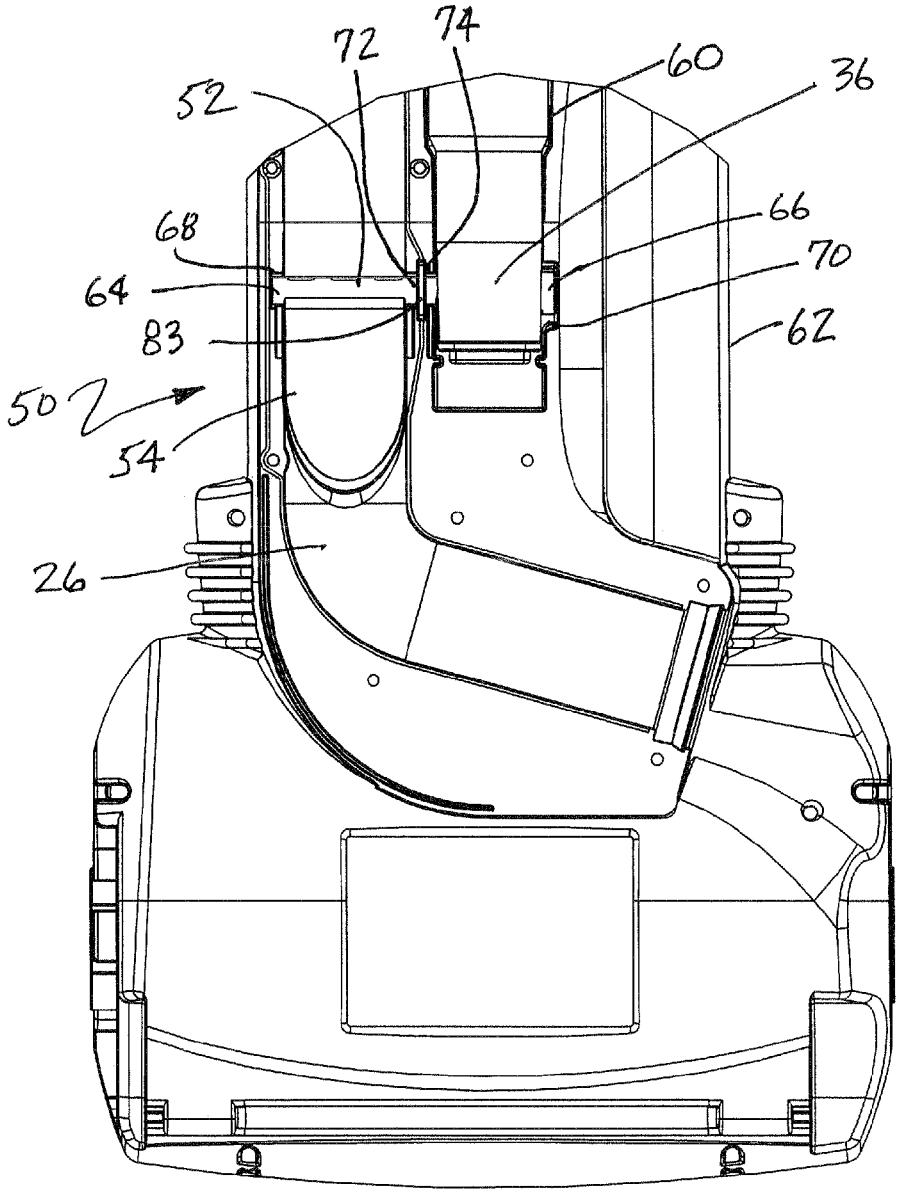
FIG. 3 is a detailed rear elevational view showing how the flow control valve and biasing spring are mounted in the canister assembly to allow for pivoting movement about the pivot shaft of the flow control valve.

As best illustrated in FIGS. 2 and 3, the flow control valve 50 include a pivot shaft 52 that carries a valve body 54 and an actuator 56. The actuator 56 carries a sealing ring 58 that is sized and shaped to plug the open or suction end 44 of the cleaning wand assembly 32 (see FIG. 4*a*) when the cleaning wand assembly 32 is received in the wand receiver 60 carried on the housing 12 and fully seated on the actuator 56 of the flow control valve 50. This will be described in greater detail below.

As best illustrated in FIG. 3, the flow control valve 50 is mounted for pivoting movement with respect to the rear shell 62 of the canister assembly 16. More specifically, the first and second ends 64, 66 of the pivot shaft 52 are received in cooperating grooves 68, 70 provided on the rear shell 62 while an intermediate section 72 of the pivot shaft between the valve body 54 and actuator 56 is received in the slot 74 provided on the rear shell 62.

The flow control valve 50 is biased into a normally closed position by means of a leaf-spring 76 having a first end received in a notch or groove 78 on the underside of the actuator 56 opposite the sealing ring 58. The opposite end of the leaf-spring 76 engages the bottom wall 80 of the wand receiver 60 formed in the rear shell 62. A cover 82 may be secured to the rear shell 62 by fasteners such as screws (not shown). A keeper lug 83 is carried on the cover 82. The keeper lug 83 includes a channel 84 that receives the pivot shaft 72 and functions to hold the pivot shaft 72 in place in the slot 74. The cover 82 may be removed to provide access to the flow control valve 50, the first air flow pathway 26 and the wand receiver 60 for service if needed.

During normal upright vacuum cleaner operation, the cleaning wand assembly 32 is received in the wand receiver 60 on the rear of the canister assembly 16. In this first position, the suction end 44 of the cleaning wand assembly 32 is fully seated on the actuator 56 so that the sealing ring 58 completely closes the suction end to prevent air flow through the wand assembly (see FIG. 4*a*).

The cleaning wand assembly 32 is secured in the first position by means of a locking mechanism including a spring loaded latch 120 carried on the canister housing 16. When the wand assembly 32 is fully seated in the wand receiver 60, the latch 120 is biased into engagement with the latching slot 122 on the wand assembly 32 thereby securing the wand assembly. When one wishes to remove the wand assembly 32 from the canister housing 16 for specialty cleaning, one depresses the actuator 124. This action releases the latch 120 from the slot 122 thereby freeing the wand assembly 32 for removal or withdrawal from the wand receiver 60.

Figure 4A:
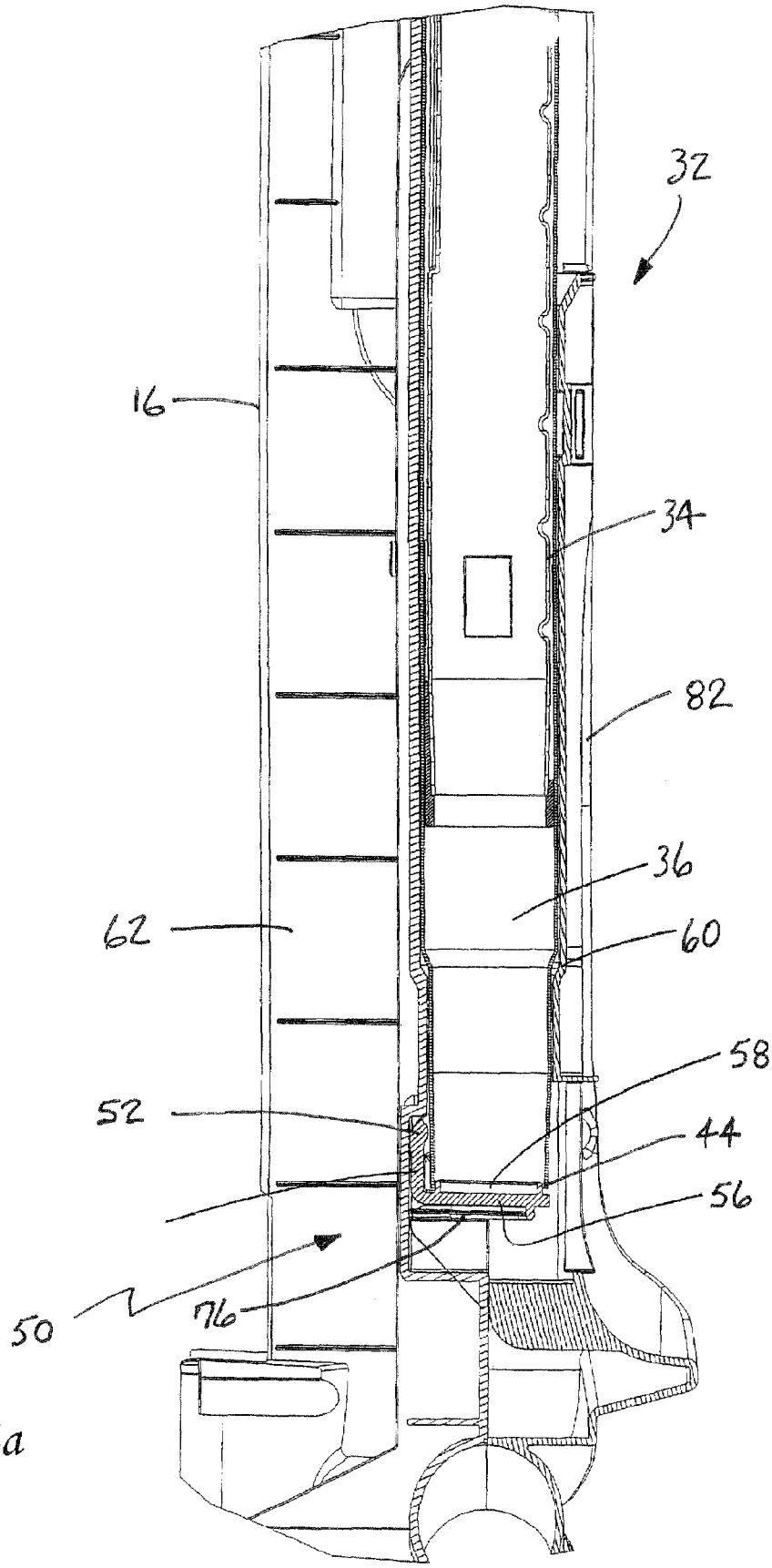
FIG. 4*a* is a detailed cross sectional view illustrating the cleaning wand assembly in the first position, received in the wand receiver and fully seated on the actuator.
Figure 4B:
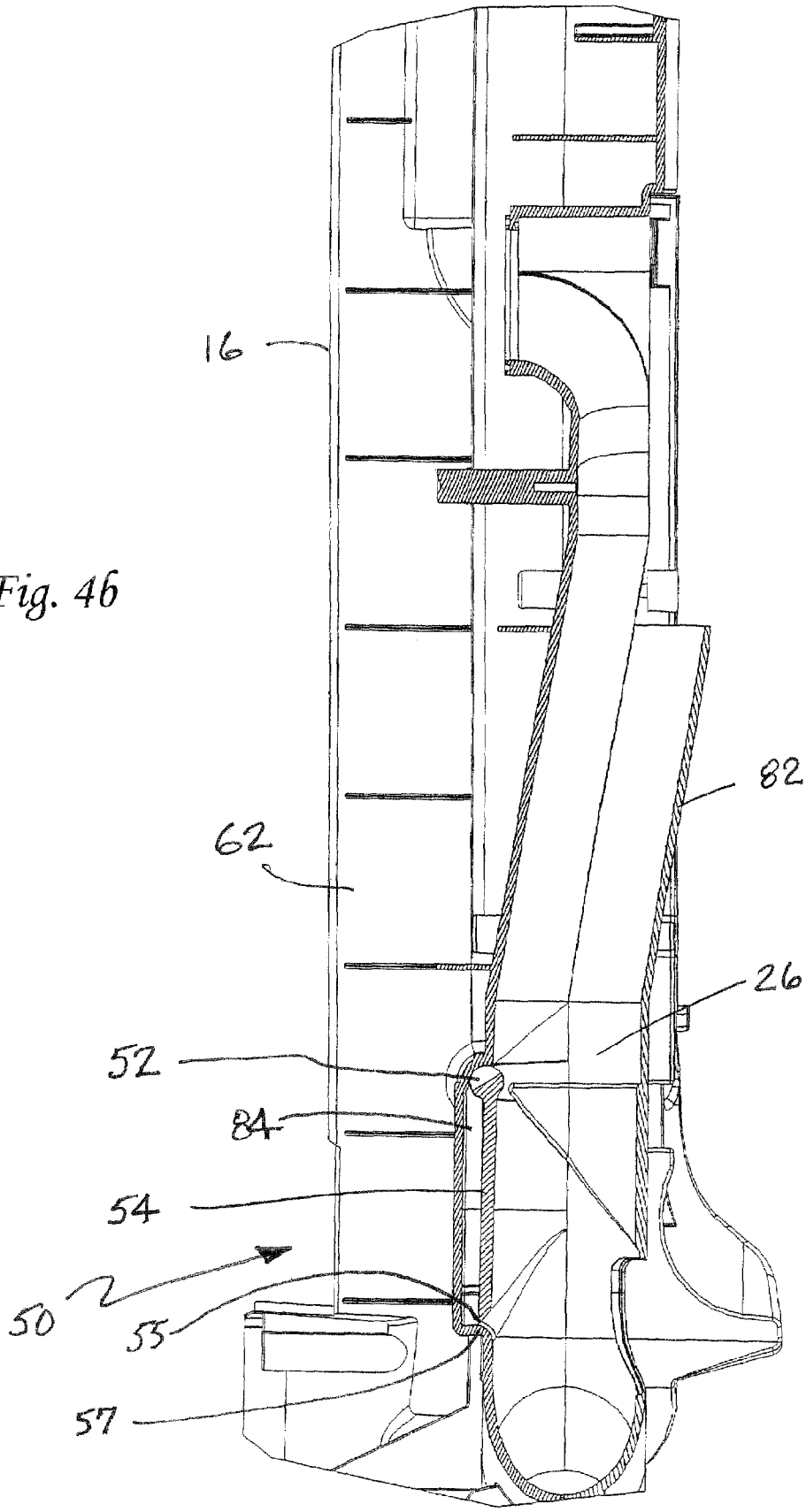
FIG. 4*b* is a cross sectional view illustrating the position of the valve body in the first air pathway when the cleaning wand assembly is in the first position as illustrated in FIG. 4*a;*

When the cleaning wand assembly 32 is in the first position as illustrated in FIG. 4*a*, the valve body 54 is pivoted into the cavity 84 formed in the first airflow pathway 26 so that the first air flow pathway is fully open. The valve body 54 engages the wall of the cavity 84 so as to prevent dirt and debris from entering the cavity (note end 55 of valve body 54 engaging the wall at point 57). Thus, when the cleaning wand assembly 32 is in the first position, the control handle 40 of the cleaning wand assembly 32 may be used to manipulate the vacuum cleaner back and forth across the floor. Dirt and debris drawn into the suction inlet 18 flows freely through the first air flow pathway 26 past the flow control valve 50 into the dirt collection vessel 22. Dirt and debris are collected in the dirt collection vessel 22 before the air stream is then drawn through the suction generator 24 and returned to the environment.

Figure 5A:
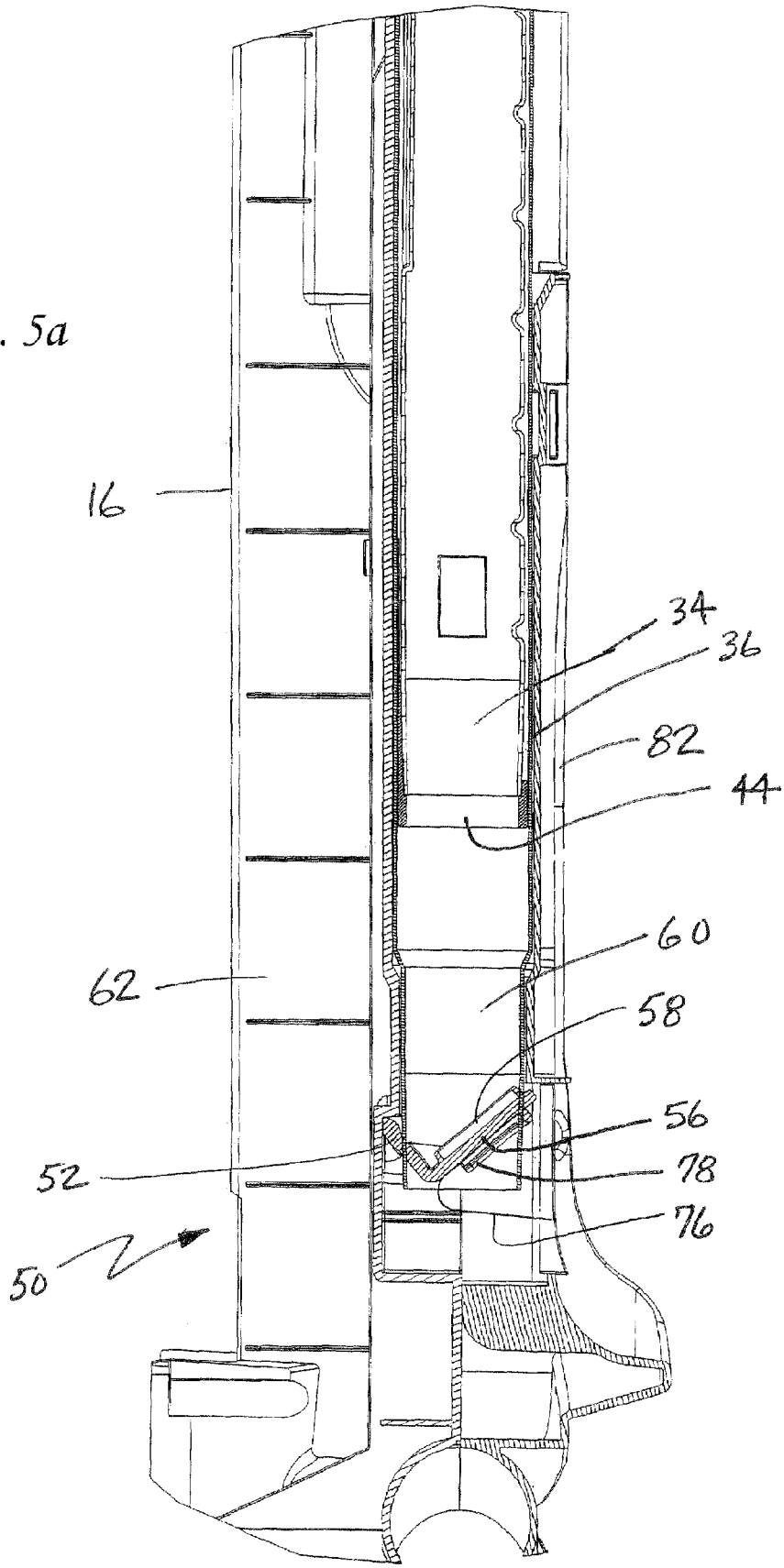
FIG. 5*a* is a cross sectional view similar to FIG. 4*a* but illustrating the wand cleaning assembly in the second position as it is withdrawn from the fully seated position in the wand receiver.
Figure 5B:
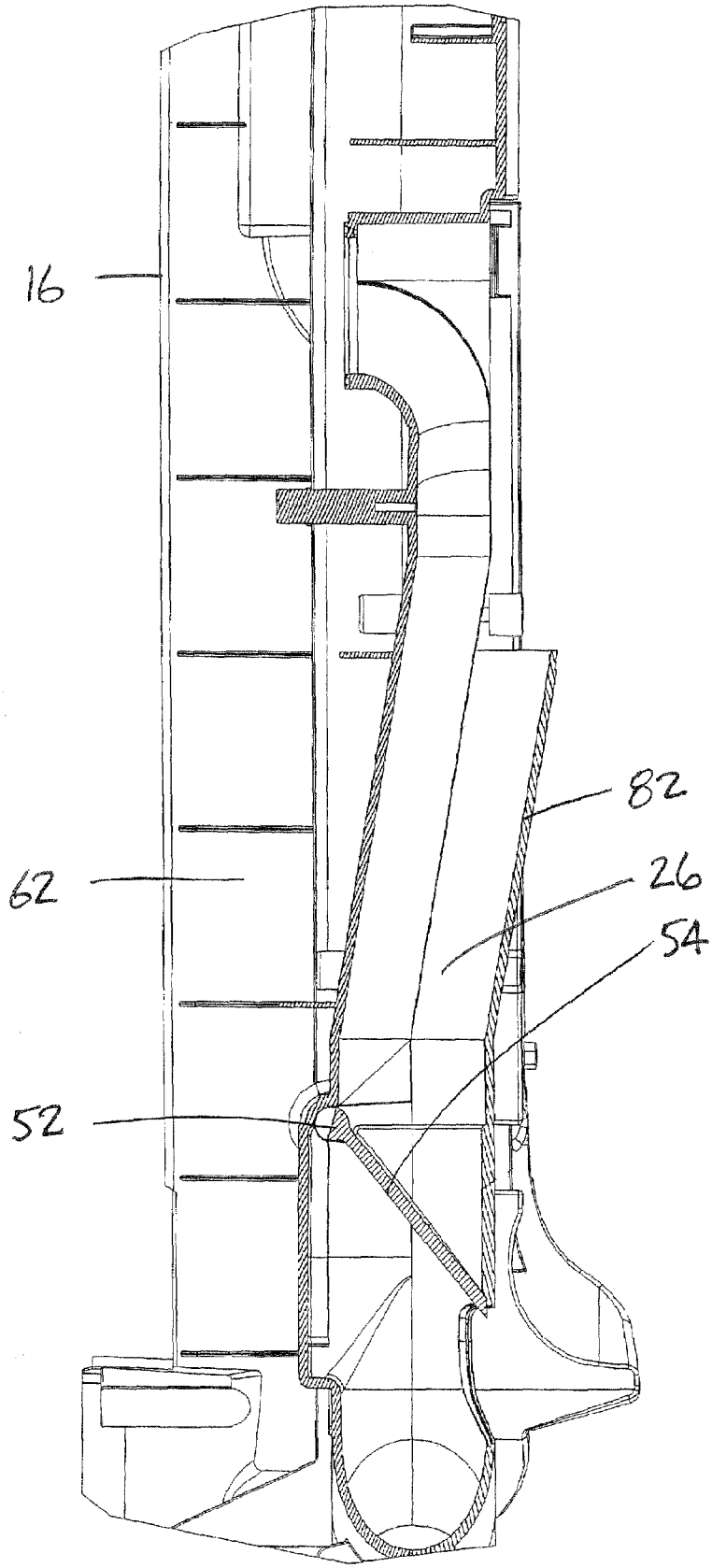
FIG. 5*b* is a cross sectional view similar to FIG. 4*b* but illustrating the position of the valve body in the first air flow pathway when the cleaning wand assembly is in the second position withdrawn from the wand receiver as illustrated in FIG. 5*a;*

When the operator desires to perform a specialty cleaning function using the cleaning wand assembly 32, the operator depresses the actuator 124 to release the latch 120 from the latching slot 122 as described above. The cleaning wand assembly 32 is then withdrawn from the wand receiver 60. As the cleaning wand assembly 32 is being withdrawn, the suction end 44 thereof becomes unseated from the actuator 56. The leaf-spring 76 then functions to bias the flow control valve 50 to its normally closed position (see FIGS. 5*a* and 5*b*). When this occurs, the valve body 54 extends across and fully closes the first air flow pathway 26 leading to the suction inlet 18.

When the suction end 44 of the cleaning wand assembly 32 is removed from the sealing ring 58 of the actuator 56, air is drawn by the suction generator 24 through the cleaning wand assembly 32, the second air flow pathway 48, and the first air flow pathway 26 upstream of the valve body 54 into the dirt collection vessel 22. Thus, dirt and debris drawn into the vacuum cleaner 10 through the cleaning wand assembly 32 is trapped in the dirt collection vessel 22 before the air stream is drawn through the suction generator 24 and returned to the environment (see also FIG. 7).

The foregoing description of the preferred embodiment of this invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. A floor care apparatus comprising:

a housing including a nozzle assembly including a suction inlet and a canister assembly connected to said nozzle assembly;

a dirt collection vessel carried on said housing;

a suction generator carried on said housing;

a first air flow pathway connecting said suction inlet to said dirt collection vessel and said suction generator;

a wand receiver carried on said housing;

an air flow control valve having a valve body received in said first air flow pathway and an actuator having at least a portion thereof extending into said wand receiver;

a cleaning wand assembly displaceable between a first storage position wherein a first end of said cleaning wand assembly is held in said wand receiver engaging said actuator and opening said valve and a second position wherein said cleaning wand assembly is withdrawn from said wand receiver for cleaning with said cleaning wand assembly thereby disengaging said actuator and closing said valve; and a second air flow pathway connecting said cleaning wand assembly to said first air flow pathway between said valve body and said dirt collection vessel;

said actuator being characterized by including a plug for sealing and closing an open end of said cleaning wand assembly when said cleaning wand assembly is in said first position.

2. The floor care apparatus of claim 1, further including a spring connected to said flow control valve and biasing said flow control valve into a normally closed position.

3. The floor care apparatus of claim 2, wherein said flow control valve includes a pivot shaft and said valve body and said actuator pivot about a pivot axis defined by said pivot shaft.

4. The floor care apparatus of claim 1, further including a spring connected to said flow control valve and biasing said flow control valve into a normally closed position.

5. The floor care apparatus of claim 1, wherein said dirt collection vessel is a filter bag.

6. The floor care apparatus of claim 1, wherein said dirt collection vessel is a dirt cup.

7. The floor care apparatus of claim 6, wherein said dirt cup includes a cylindrically shaped dirt collection chamber, a tangentially directed inlet and an axially directed outlet.

8. The floor care apparatus of claim 7, further including a primary filter in said dirt cup upstream from said axial outlet.

9. The floor care apparatus of claim 8, further including a secondary filter in said first air flow pathway between said dirt cup and said suction generator.

10. The floor care apparatus of claim 9, further including a final filter in said first air flow pathway downstream from said suction generator.

11. The floor care apparatus of claim 10, further including at least one rotary agitator carried by said nozzle assembly adjacent said suction inlet.

12. The floor care apparatus of claim 1, further including at least one rotary agitator carried by said nozzle assembly adjacent said suction inlet.

13. The floor care apparatus of claim 1, wherein said canister assembly is pivotally connected to said nozzle assembly.

14. The floor care apparatus of claim 1, wherein said cleaning wand assembly includes a flexible hose.

15. The floor care apparatus of claim 14, wherein said cleaning wand assembly includes first and second telescoping sections.

16. The floor care apparatus of claim 5, wherein said cleaning wand assembly includes a control handle.

* * * * *